US009848744B1

(12) United States Patent
Hobbs

(10) Patent No.: US 9,848,744 B1
(45) Date of Patent: Dec. 26, 2017

(54) NESTED GRADUATED TOILET SEATS

(71) Applicant: Gayle Hobbs, Livingston, NJ (US)

(72) Inventor: Gayle Hobbs, Livingston, NJ (US)

( * ) Notice: Subject to any disclaimer, the term of this patent is extended or adjusted under 35 U.S.C. 154(b) by 0 days.

(21) Appl. No.: 15/176,961

(22) Filed: Jun. 8, 2016

(51) Int. Cl.

| | |
|---|---|
| ***A47K 13/00*** | (2006.01) |
| ***A47K 13/24*** | (2006.01) |
| ***A47K 13/12*** | (2006.01) |
| ***A47K 13/06*** | (2006.01) |

(52) U.S. Cl.
CPC ..... *A47K 13/24* (2013.01); *A47K 13/005* (2013.01); *A47K 13/06* (2013.01); *A47K 13/12* (2013.01)

(58) Field of Classification Search
CPC ..... A47K 13/00; A47K 13/005; A47K 13/06; A47K 13/12; A47K 13/24
USPC ..... 4/235, 239
See application file for complete search history.

(56) References Cited

U.S. PATENT DOCUMENTS

| | | | | |
|---|---|---|---|---|
| 54,480 | A | 5/1866 | Alexander | |
| 674,166 | A * | 5/1901 | Joralemon | A47K 13/12 144/346 |
| 2,047,480 | A * | 7/1936 | MacDonald | A47K 13/06 4/234 |
| 3,786,522 | A * | 1/1974 | Kira | A47K 13/00 4/237 |
| 4,175,294 | A * | 11/1979 | Boyd | A47K 13/24 4/234 |
| RE32,807 | E | 12/1988 | Adams | |
| 5,384,917 | A | 1/1995 | Epling | |
| 5,685,023 | A | 11/1997 | Alston | |
| 6,449,780 | B1 | 9/2002 | Merry | |
| 6,701,539 | B1 | 3/2004 | Hogan | |
| 6,952,842 | B2 | 10/2005 | Courtney | |
| D573,702 | S * | 7/2008 | Berberet | D23/311 |
| D715,567 | S | 10/2014 | Lensing | |
| 9,204,768 | B2 * | 12/2015 | Green | A47K 13/005 |
| 9,226,864 | B2 | 1/2016 | Gianfagna et al. | |
| 2003/0097708 | A1 | 5/2003 | Zhang | |
| 2003/0172448 | A1 * | 9/2003 | Courtney | A47K 13/06 4/235 |

(Continued)

FOREIGN PATENT DOCUMENTS

| | | | |
|---|---|---|---|
| GB | EP0535770 | A1 | 4/1993 |
| GB | WO 2008/020189 | A1 | 2/2008 |
| WO | WO 94/13185 | | 6/1994 |

*Primary Examiner* — J. Casimer Jacyna
(74) *Attorney, Agent, or Firm* — Thomas J. Germinario

(57) ABSTRACT

An assembly of cooperatively hinged nested toilet seats of sizes downwardly graduated from smaller to larger, from a smallest top seat to a largest bottom first seat. Each of the relatively smaller seats nests within a declining inner seat contour of a relatively larger seat below it. An extension of the declining inner seat contour of each seat defines a downward seat flange, which is configured to extend within the rim of the toilet bowl when the seat is lowered. Each successively smaller seat has a downward seat flange which is configured, when the seat is lowered, to nest within and engage the inner perimeter of the seat opening defined by the downward seat flange of the seat below it. The cross-sectional profile of each of the nested toilet seats comprises the downward seat flange, which transitions into the declining inner seat contour, which transitions into a middle seat contour, which in turn transitions into an outer seat contour.

4 Claims, 7 Drawing Sheets

(56) References Cited

U.S. PATENT DOCUMENTS

2009/0260142 A1* 10/2009 Fahmie ..... A47K 13/24
4/237

* cited by examiner

NESTED GRADUATED TOILET SEATS

FIELD OF INVENTION

The present invention relates to the field of toilet seats, and more particularly to toilet seat assemblies comprising multiple toilet seats of different sizes.

BACKGROUND OF THE INVENTION

Standard sized toilet seats are designed to accommodate the body contours of an average adult. They are not well suited to small children, who often must support themselves with their arms to avoid falling through the seat opening. This problem makes the process of toilet training young children all the more difficult.

Large and obese adults often have the opposite problem, as their bottom body contours extend well beyond the rim of the standard toilet seat, making it difficult for them to maintain their balance on the seat.

Attempts to address these problems have included special toilet seat inserts, such as child seats. But small children usually cannot deploy such inserts without adult assistance, which defeats the goal of enabling the child to use the toilet independently.

Another approach has been tiered toilet seats, in which a smaller seat rests on top of a larger seat, and the two seats are cooperatively hinged. But such tiered seat configurations tend to raise the overall height of the seat, making the seating of small children and infirm adults even more difficult. Moreover, the overlapping edges of tiered toilet seats tend to generate lateral movement of the seats when bearing bodily weight, thereby making seating more unstable and less comfortable.

The cross-sectional profile of the standard toilet seat is typically flat to slightly convex, which is not optimal for stable seating. Smaller adults and children tend to fall inward on the seat, while larger adults slide outward. Aged and infirm adults often require assistance maintaining their seating on these seats, because they provide no lateral support.

(Note: As used in the following descriptions and claims, the terms "outer", "outward" or "outwardly" refer to the horizontal direction toward the perimeter of the toilet bowl, while the terms "inner", "inward" or "inwardly" refer to the horizontal direction toward the center of the toilet bowl. The terms "upper", "upward" or "upwardly" refer to the vertical direction opposite the base of the toilet bowl, while the terms "down", "downward" or "downwardly" refer to the vertical direction toward the base of the toilet bowl. The term "above" means relatively upward, while the term "below" means relatively downward. The term "top" refers to the most upward, while the term "bottom" refers to the most downward. The term "inclining" means upwardly curving, while the term "declining" means downwardly curving.)

SUMMARY OF THE INVENTION

The present invention addresses the foregoing problems by providing an assembly of cooperatively hinged nested toilet seats of sizes downwardly graduated from smaller to larger, from a smallest top seat to a largest bottom first seat. Each of the relatively smaller seats nests within a declining inner seat contour of a relatively larger seat below it.

An extension of the declining inner seat contour of each seat defines a downward seat flange, which is configured to extend within the rim of the toilet bowl when the seat is lowered. The downward seat flange of the largest bottom first seat is configured to engage the inner perimeter of the toilet bowl rim when the seat is lowered, thereby defining a largest first seat opening. The downward seat flange of the next largest second seat above the largest bottom first seat is configured to nest within and engage the inner perimeter of the first seat opening when the seat is lowered, thereby defining a next largest second seat opening. Similarly, each successively smaller third, fourth, fifth, etc., seat has a downward seat flange which is configured, when the seat is lowered, to nest within and engage the inner perimeter of the seat opening defined by the downward seat flange of the seat below it.

The cross-sectional profile of each of the nested toilet seats comprises the downward seat flange, which transitions into the declining inner seat contour, which transitions into a middle seat contour, which in turn transitions into an outer seat contour. In the first embodiment of the present invention, the middle seat contours are substantially convex, and the outer seat contours are declining. In the second embodiment of the present invention, the middle seat contours are substantially concave, and the outer seat contours are inclining.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1A:
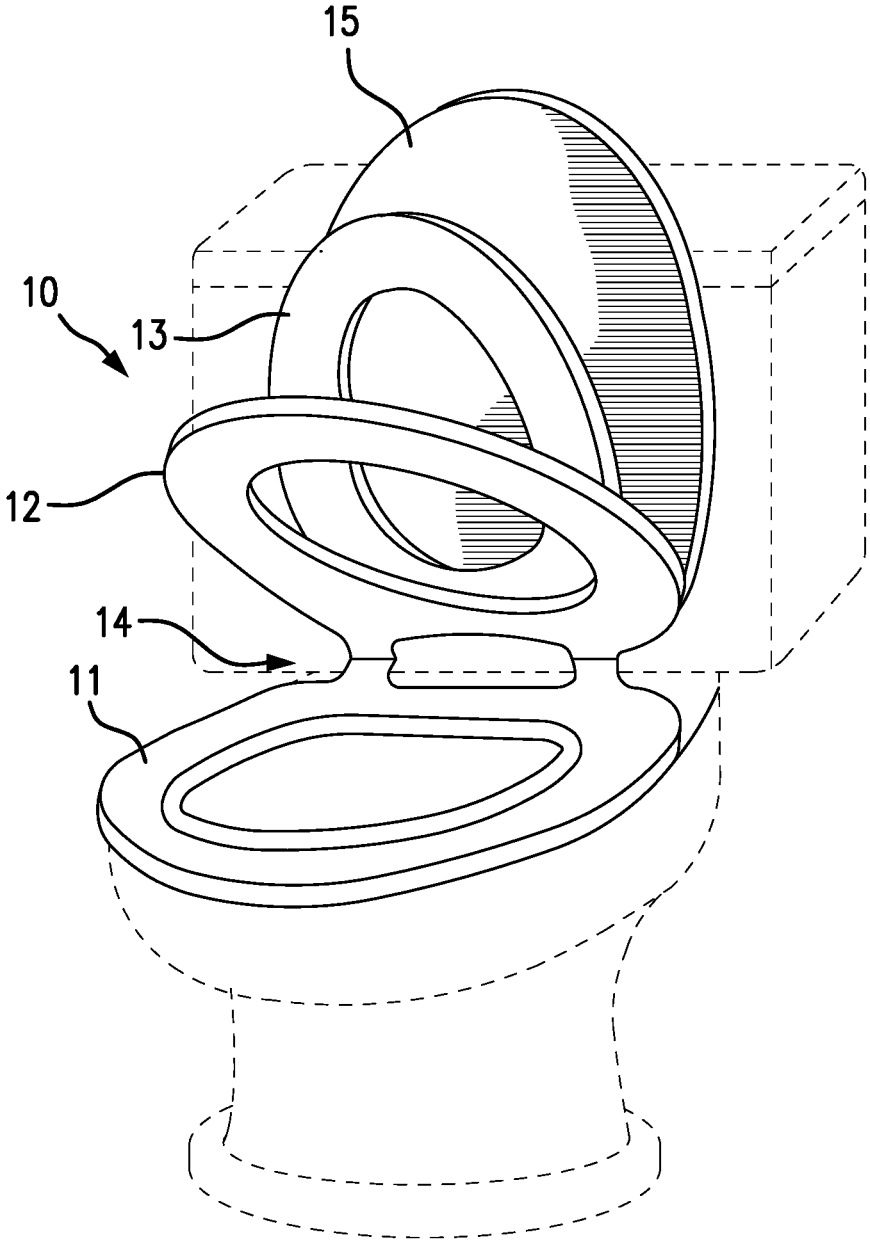
FIG. 1A is a perspective view of the first embodiment of the present invention comprising a three-seat assembly, showing the lid lifted, the bottom seat lowered, and the two upper seats partially lifted, with the toilet in ghost view.
Figure 1B:
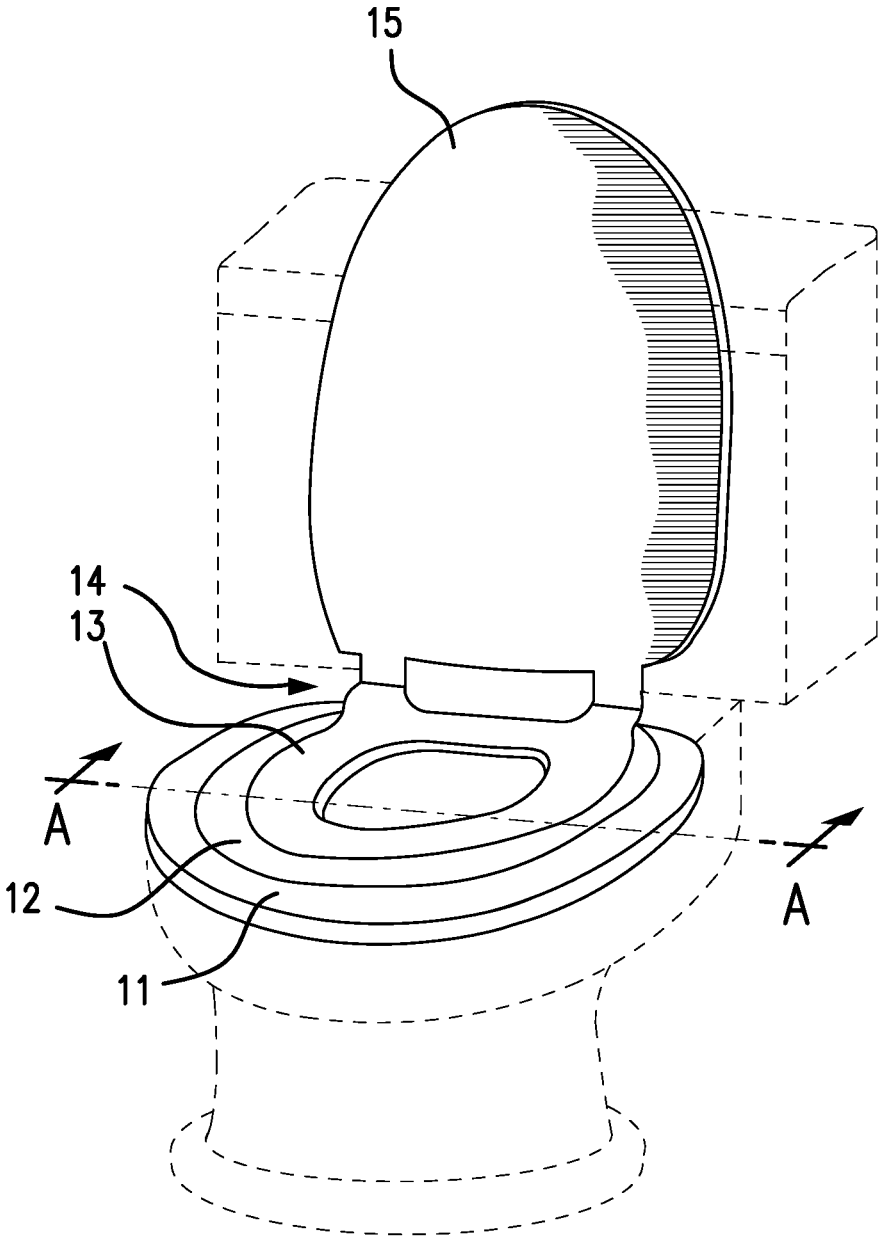
FIG. 1B is a perspective view of first embodiment of the present invention, showing the lid lifted and all three seats lowered, with the toilet in ghost view.
Figure 3:
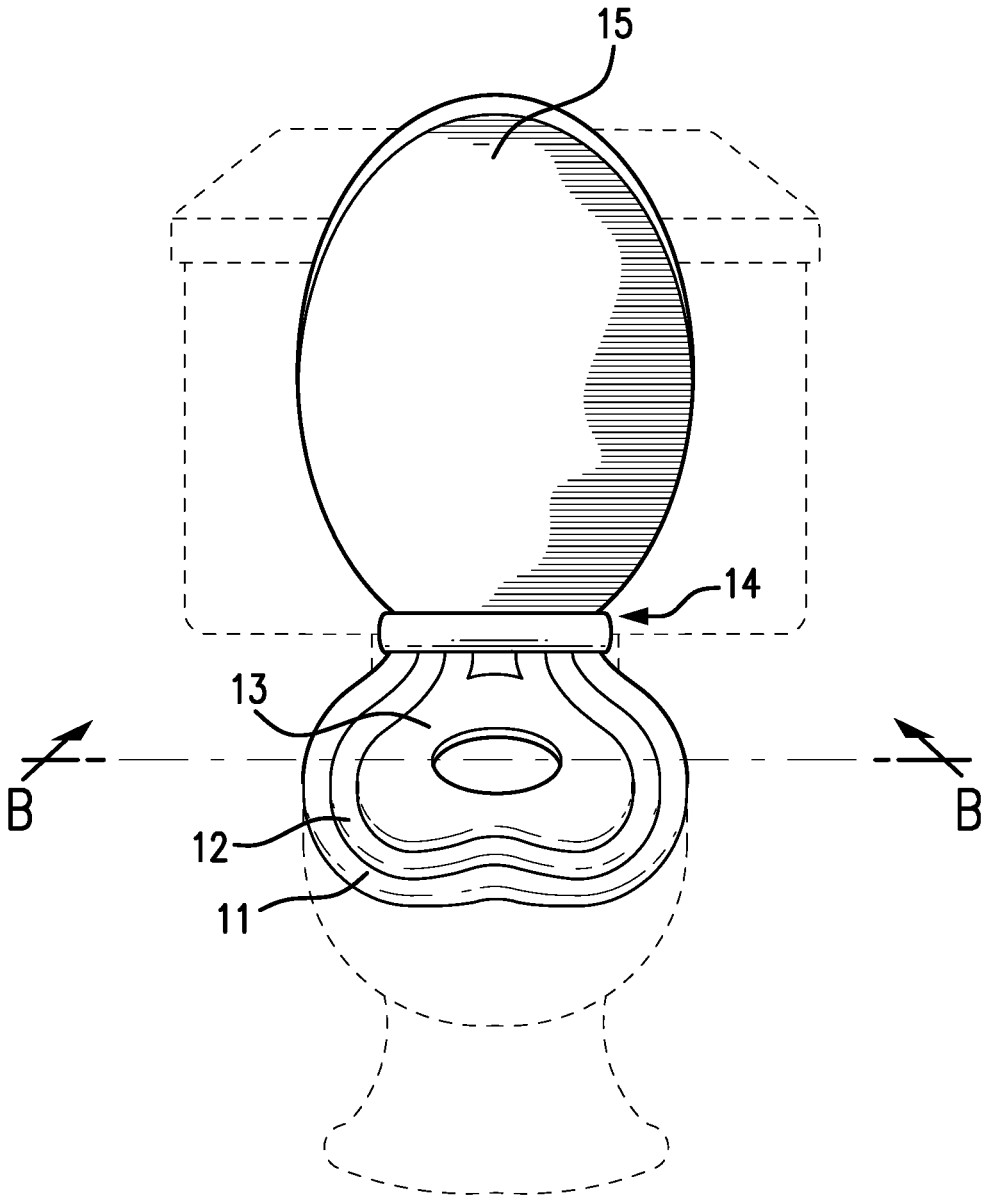
FIG. 3 is a perspective view of the second embodiment of the present invention, showing the lid lifted and all three seats lowered, with the toilet in ghost view.

Referring the FIGS. 1A and 1B, the first embodiment of the present invention is an assembly of three toilet seats 10 comprising a largest bottom first seat 11, a mid-sized second seat 12 above and smaller than the first seat 11, and a smallest third seat 13, above and smaller than the second seat 12. The assembly is cooperatively hinged 14, so that each of the seats 11 12 13 and the seat lid 15 can be independently raised and lowered. FIG. 3 depicts the equivalent structures for the second embodiment of the present invention.

Figure 2:
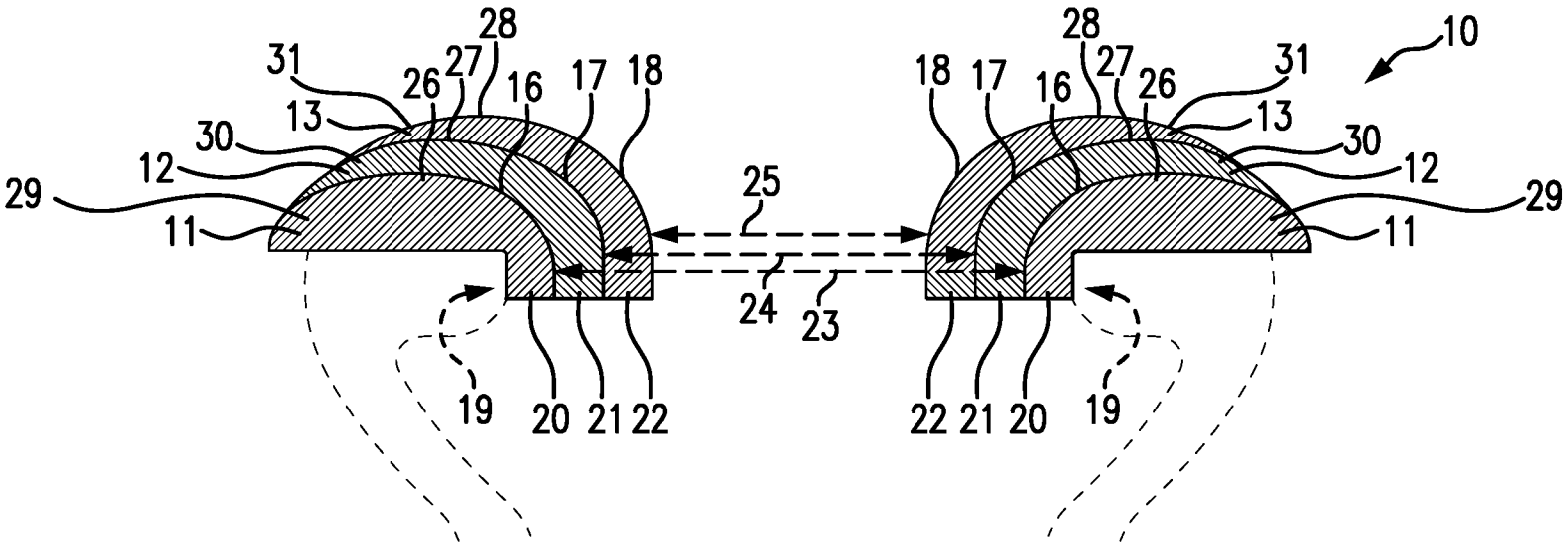
FIG. 2 is a cross-section view of the three seats depicted in FIG. 1B, taken along the line A-A, with the toilet bowl rim in ghost view.
Figure 4:
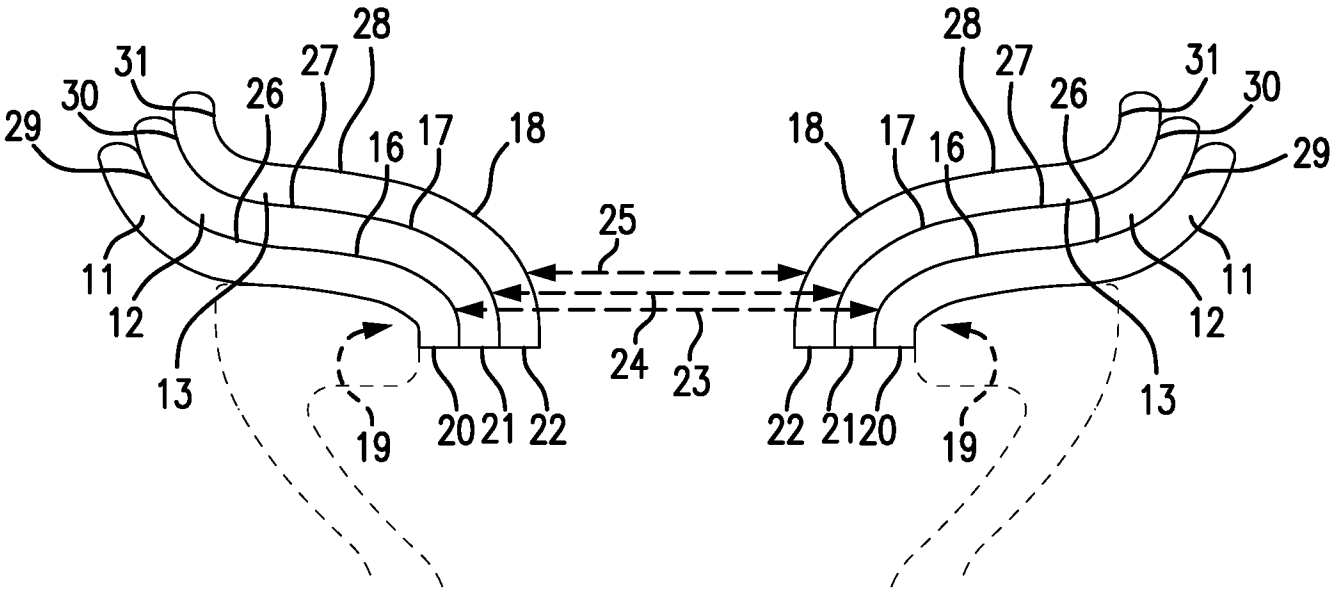
FIG. 4 is a cross-section view of the three seats depicted in FIG. 3, taken along the line B-B, with the toilet bowl rim in ghost view.

As best seen in FIGS. 1B and 2, for the first embodiment, and in FIGS. 3 and 4 for the second embodiment, each of the relatively smaller seats nests within a declining inner seat contour of the larger seat below it. Therefore, as shown in FIGS. 2 and 4, the mid-sized second seat 12 nests within the declining inner seat contour of the largest first seat 16, while the smallest third seat 13 nests within the declining inner seat contour of the mid-sized second seat 17. The declining inner seat contour of the smallest third seat 18 rests atop the declining inner seat contour of the mid-sized second seat 17.

Referring again to FIGS. 2 and 4, an extension of the declining inner seat contour of each seat defines a downward seat flange, which is configured to extend within the toilet bowl rim 19 when the seat is lowered. The downward seat flange of the largest first seat 20, when lowered, engages the inner perimeter of the toilet bowl rim 19, thereby defining a largest first seat opening 23. The downward seat flange of the mid-sized second seat 21, when lowered, engages the inner perimeter of the first seat opening 23 thereby defining a mid-sized second seat opening 24. The downward seat flange of the smallest third seat 22, when lowered, engages the inner perimeter of the second seat opening 24, thereby defining a smallest third seat opening 25.

As depicted in FIGS. 2 and 4, the cross-sectional profile of each of the nested toilet seats comprises the downward seat flange (for the first seat 20, second seat 21, third seat 22), which transitions into the declining inner seat contour (for the first seat 16, second seat 17, third seat 18), which transitions into a middle seat contour (for the first seat 26, second seat 27, third seat 28), which in turn transitions into an outer seat contour (for the first seat 29, second seat 30, third seat 31). In the first embodiment, as shown in FIG. 2, the middle seats contours (26, 27 and 28) are substantially convex, and the outer seat contours (29, 30 and 31) are declining. In the second embodiment, as shown in FIG. 4, the middle seat contours (26, 27 and 28) are substantially concave, and the outer seat contours (29, 30 and 31) are inclining.

Figure 5B:
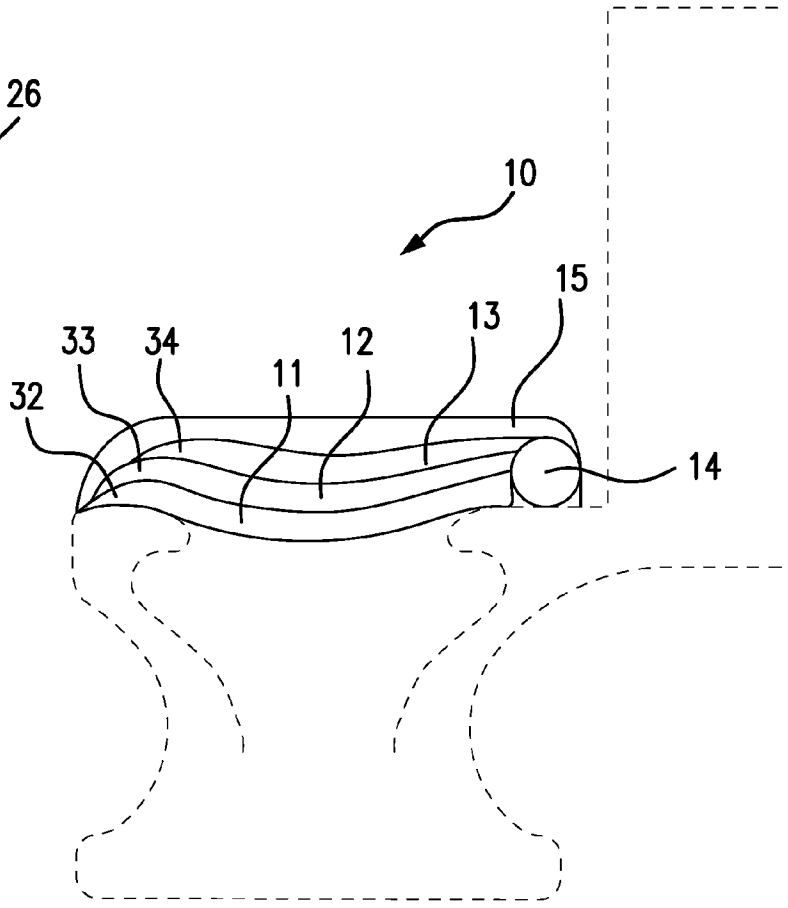
FIG. 5B is a side profile view of the second embodiment of the present invention, comprising a three-seat assembly, showing the lid and all three seats lowered, with the toilet in ghost view.
Figure 5A:
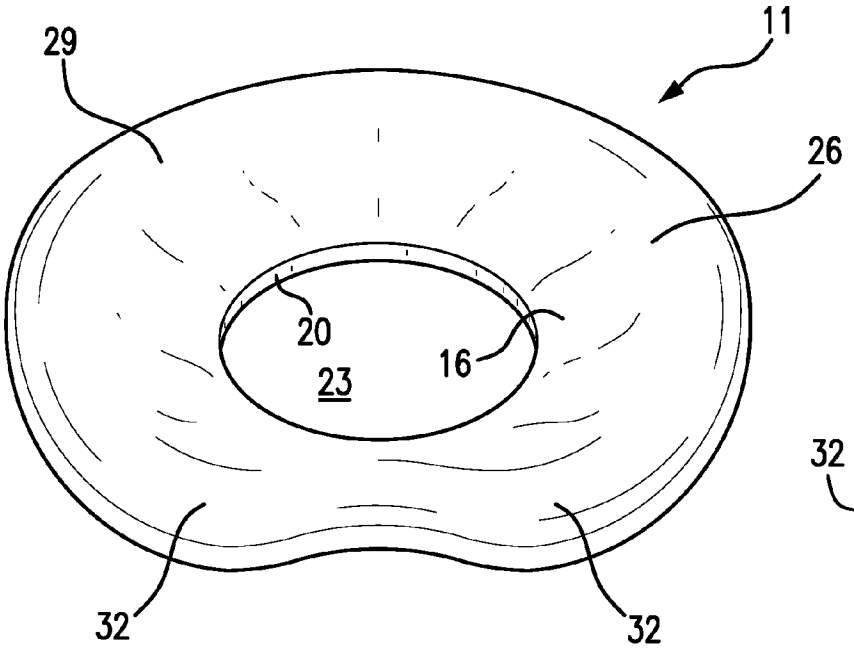
FIG. 5A is a perspective view of a toilet seat according to the second embodiment of the present invention.

As depicted in FIG. 5A, the three seats of the second embodiment have the shape of a "tractor seat" 11, with a substantially concave inner contours 26, inclining outer contours 29 in the back and sides of the seat, and two declining limb contours 32 in the front of the seat to accommodate the user's legs. FIG. 5B shows in profile the declining limb contours for the first seat 32, for the second seat 33 and for the third seat 34.

Figure 6:
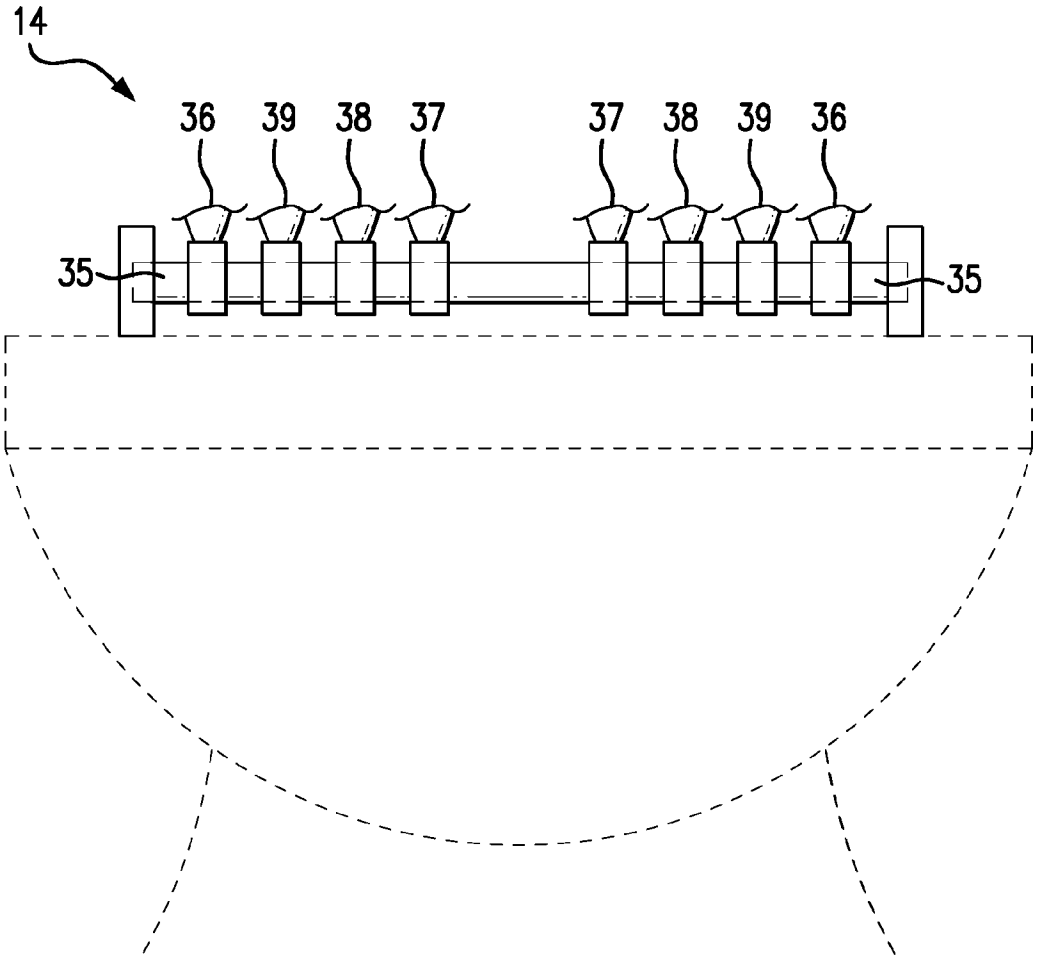
FIG. 6 is a detail cutaway rear view of an exemplary composite hinge for the present invention.

FIG. 6 depicts an exemplary cooperative hinge structure 14 for the first embodiment, showing rotary connections to a common hinge rod 35 for the seat lid 36, the third seat 37, the second seat 38, and the first seat 39. The hinge structure for the second embodiment would be the same.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A toilet seat assembly, comprising:

three or more toilet seats of sizes downwardly graduated from relatively smaller toilet seats to relatively larger toilet seats, from a smallest top toilet seat to a largest bottom toilet seat;

a toilet seat lid, which is configured to fit over and cover the toilet seats;

wherein the toilet seats and the toilet seat lid are connected to a common cooperative hinge member, which is configured so that each of the toilet seats and the toilet seat lid can be independently raised and lowered;

wherein each of the toilet seats has a substantially annular or oval annular shape, which defines a central, substantially circular or oval seat opening, and wherein the seat openings are downwardly graduated from a smallest top seat opening to a largest bottom seat opening;

wherein each of the toilet seats comprises the seat opening, a downward seat flange surrounding the seat opening, a declining inner seat contour surrounding and transitioning into the downward seat flange, a middle seat contour surrounding and transitioning into the declining inner seat contour, and an outer seat contour surrounding and transitioning into the middle seat contour;

wherein each of the relatively smaller toilet seats, when lowered, nests within the declining inner seat contour of the relatively larger toilet seat below it, and the downward seat flange of the relatively smaller toilet seat engages an entire inner perimeter of the downward seat flange of the relatively larger toilet seat below it, so as to define the seat opening of the relatively smaller toilet seat; and wherein the largest bottom seat, when lowered, rests on a toilet bowl rim, and the downward seat flange of the largest bottom seat engages an inner perimeter of the toilet bowl rim, so as to define the largest bottom seat opening.

2. The toilet seat assembly of claim 1, wherein the middle seat contour of each toilet seat is substantially convex, and the outer seat contour of each toilet seat is substantially declining.

3. The toilet seat assembly of claim 1, wherein the middle seat contour of each toilet seat is substantially concave, and the outer seat contour of each toilet seat is substantially inclining.

4. The toilet seat assembly of claim 3, wherein each toilet seat has a front portion, having two declining limb contours, which are configured to accommodate a user's legs.

* * * * *